US010920642B2

(12) United States Patent
Wang et al.

(10) Patent No.: US 10,920,642 B2
(45) Date of Patent: Feb. 16, 2021

(54) MIXER AND EXHAUST AFTERTREATMENT SYSTEM

(71) Applicant: Faurecia Emission Control Technologies (Shanghai) Co., Ltd., Shanghai (CN)

(72) Inventors: Jie Wang, Shanghai (CN); Gerard Bertran, Shanghai (CN)

(73) Assignee: Faurecia Emission Control Technologies (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 16/521,898

(22) Filed: Jul. 25, 2019

(65) Prior Publication Data

US 2020/0032692 A1 Jan. 30, 2020

(30) Foreign Application Priority Data

Jul. 25, 2018 (CN) ..... 2018 2 1190661 U

(51) Int. Cl.
*F01N 13/08* (2010.01)
*F01N 3/28* (2006.01)
*F01N 3/029* (2006.01)

(52) U.S. Cl.
CPC ..... *F01N 3/2892* (2013.01); *F01N 3/0293* (2013.01); *F01N 2610/02* (2013.01)

(58) Field of Classification Search
CPC ..... F01N 1/083; F01N 3/0293; F01N 3/2892; F01N 2240/20; F01N 2610/02
See application file for complete search history.

(56) References Cited

U.S. PATENT DOCUMENTS

2014/0318112 A1* 10/2014 Solbrig ..... F01N 3/208 60/324
2016/0361694 A1* 12/2016 Brandl ..... B01F 5/0693
2018/0066559 A1* 3/2018 Haverkamp ..... F01N 3/10

* cited by examiner

*Primary Examiner* — Jonathan R Matthias
(74) *Attorney, Agent, or Firm* — Quarles & Brady LLP

(57) ABSTRACT

The present disclosure relates to a mixer and an exhaust aftertreatment system comprising the mixer. The mixer comprises a shell, an injection port, a first baffle, a second baffle, a deflector, and an impactor, wherein the first baffle is provided with a gas inlet, the second baffle is provided with a gas outlet, the first baffle and the second baffle are disposed opposite each other, and the first baffle, the second baffle and the shell provide a flow space for an exhaust gas to flow in the mixer; and in the flow space, the first baffle, the shell, the deflector and the impactor provide a mixing space, the deflector comprises a first deflecting surface opposite the first baffle, the deflector is disposed adjacent to the impactor, and the impactor is disposed opposite the injection port for impacting a liquid injected from the injection port into the mixing space. The mixer and the exhaust aftertreatment system have the advantages of a simple structure and a high processing efficiency.

16 Claims, 6 Drawing Sheets

MIXER AND EXHAUST AFTERTREATMENT SYSTEM

CROSS-REFERENCE TO RELATED APPLICATIONS

This application claims the benefit of Chinese Patent Application No. 201821190661.5 filed Jul. 25, 2018, which is incorporated herein by reference for all purposes.

TECHNICAL FIELD

The present disclosure relates to a mixer and an exhaust aftertreatment system comprising the mixer.

BACKGROUND ART

In recent years, regulations on emissions and fuel consumption of power systems have become stricter, and engines need to perform full combustion due to the strict fuel consumption regulations. The cost of full combustion is an increase in the content of nitrogen oxides in an exhaust gas, which is also limited by strict emission regulations. In the European "Euro VI" diesel engine emission standards, particulate emissions from vehicles with diesel engines should be less than 10 mg/kwh, and nitrogen oxide emissions should be less than 460 mg/kwh. Therefore, in the increasingly strict emission and fuel consumption standards as well as the requirements of miniaturization and lightweight of the engines, exhaust aftertreatment systems should also be improved accordingly, e.g. by adding an engine exhaust gas recirculation system, but this reduces the temperature of the engine, so that some fuel is not fully combusted, and uncombusted hydrocarbons and particulate matter emissions are increased. Therefore, in the increasingly strict emission and fuel consumption standards as well as the requirements of miniaturization and lightweight of the engines, the exhaust treatment systems must also be improved accordingly to comply with government regulations, for example, a mixer is provided to treat nitrogen oxides to reduce the nitrogen oxide emissions.

In general, the mixer is disposed upstream of a selective catalytic reduction (SCR) catalyst, an injector of the mixer injects, for example, a liquid containing urea, and the mixer is located upstream of the SCR catalyst to mix the exhaust gas discharged from the engine with a urea conversion product; and a reduction reaction is carried out on the SCR catalyst to convert the nitrogen oxides into pollution-free nitrogen and water vapor to be discharged, so as to reduce the content of nitrogen oxides in the exhaust gas and meet emission regulation standards.

In the mixer, the injector typically injects urea into an exhaust gas stream. The mixer can reduce the formation of urea deposits and improve the efficiency of treatment and conversion of nitrogen oxides. However, in the prior art mixer, the mainstream design solution is to provide a deflector with a spiral surface to increase the mixing stroke of the exhaust gas in the mixer to improve the mixing uniformity of the exhaust gas and the liquid. However, the structure of such a deflector is complicated, which puts forward higher requirements on the process; and since the stroke of the exhaust gas and the urea is relatively long, the temperature of a mixed system of the two is lowered, so that the urea deposit rate is increased.

Therefore, there is a need in the art for a mixer having a simple structure, good mixing uniformity, and a low urea deposit rate.

SUMMARY

It is an object of the present disclosure to provide a mixer.

It is an object of the present disclosure to provide an exhaust aftertreatment system.

A mixer for an exhaust aftertreatment system, according to an aspect of the present disclosure, comprises a shell, an injection port, a first baffle, a second baffle, a deflector, and an impactor, wherein the first baffle is provided with a gas inlet, the second baffle is provided with a gas outlet, the first baffle and the second baffle are disposed opposite each other, and the first baffle, the second baffle and the shell provide a flow space for an exhaust gas to flow in the mixer; and in the flow space, the first baffle, the shell, the deflector and the impactor provide a mixing space, the deflector comprises a first deflecting surface opposite the first baffle, the deflector is disposed adjacent to the impactor, and the impactor is disposed opposite the injection port for impacting a liquid injected from the injection port into the mixing space.

In an embodiment of the mixer, the impactor has a circular arc shape.

In an embodiment of the mixer, the deflector further comprises a second deflecting surface and a third deflecting surface respectively extending from two lateral ends of the first deflecting surface toward the first baffle.

In an embodiment of the mixer, the first deflecting surface is a circular arc surface, and the second deflecting surface and the third deflecting surface are planes parallel to each other.

In an embodiment of the mixer, the gas inlet and the injection port are disposed on the same side with respect to an axis of the flow space.

In an embodiment of the mixer, a radial gap is provided between the impactor and an inner wall of the shell, the radial gap and the first baffle jointly provide a heating space, and the first baffle is provided with a gas inlet opening for the exhaust gas to flow into the heating space.

In an embodiment of the mixer, the first baffle and/or the second baffle have a plurality of plug welds, and the impactor and/or the deflector are connected to the first baffle and/or the second baffle via the plug welds.

In an embodiment of the mixer, the liquid injected into the mixing space is a urea solution.

An exhaust aftertreatment system, according to another aspect of the present disclosure, comprises the mixer of any of the above embodiments.

The progressive effects of the present disclosure include at least:

1. the first deflecting surface of the deflector is disposed opposite the first baffle and adjacent to the impactor, so that most of the exhaust gas enters from the gas inlet of the first baffle, impacts with the first deflecting surface, and under the combined action of the attractive force of the injected liquid and the resistance of the first deflecting surface, is forcibly deflected to the impactor disposed adjacent to the deflector, and the heat of the exhaust gas sufficiently heats the impactor, so that the injected liquid is fully atomized by the heat and impact with the impactor to be decomposed into extremely fine droplets, thus increasing the specific surface area of the liquid and enabling same to be sufficiently mixed with the exhaust gas;
2. the mixing of the exhaust gas and the liquid can be completed within a limited mixing distance, so that the mixer can further reduce the axial size and save on the valuable arrangement space inside the exhaust aftertreatment system;

3. the temperature of the impactor is high enough to effectively reduce the deposit of the solute such as a urea liquid injected into the liquid, ensuring stable and reliable operation of the mixer; and
4. the mixing efficiency of the exhaust gas and the liquid is high, which improves the treatment efficiency of the exhaust aftertreatment system, and at the same time, the exhaust back pressure of the exhaust aftertreatment system can be reduced accordingly and the fuel economy of the power system is improved.

BRIEF DESCRIPTION OF THE DRAWINGS

The above-mentioned and other features, properties and advantages of the present disclosure will become more apparent from the following description in conjunction with the accompanying drawings and the embodiments, in which.

DETAILED DESCRIPTION OF EMBODIMENTS

Figure 1:
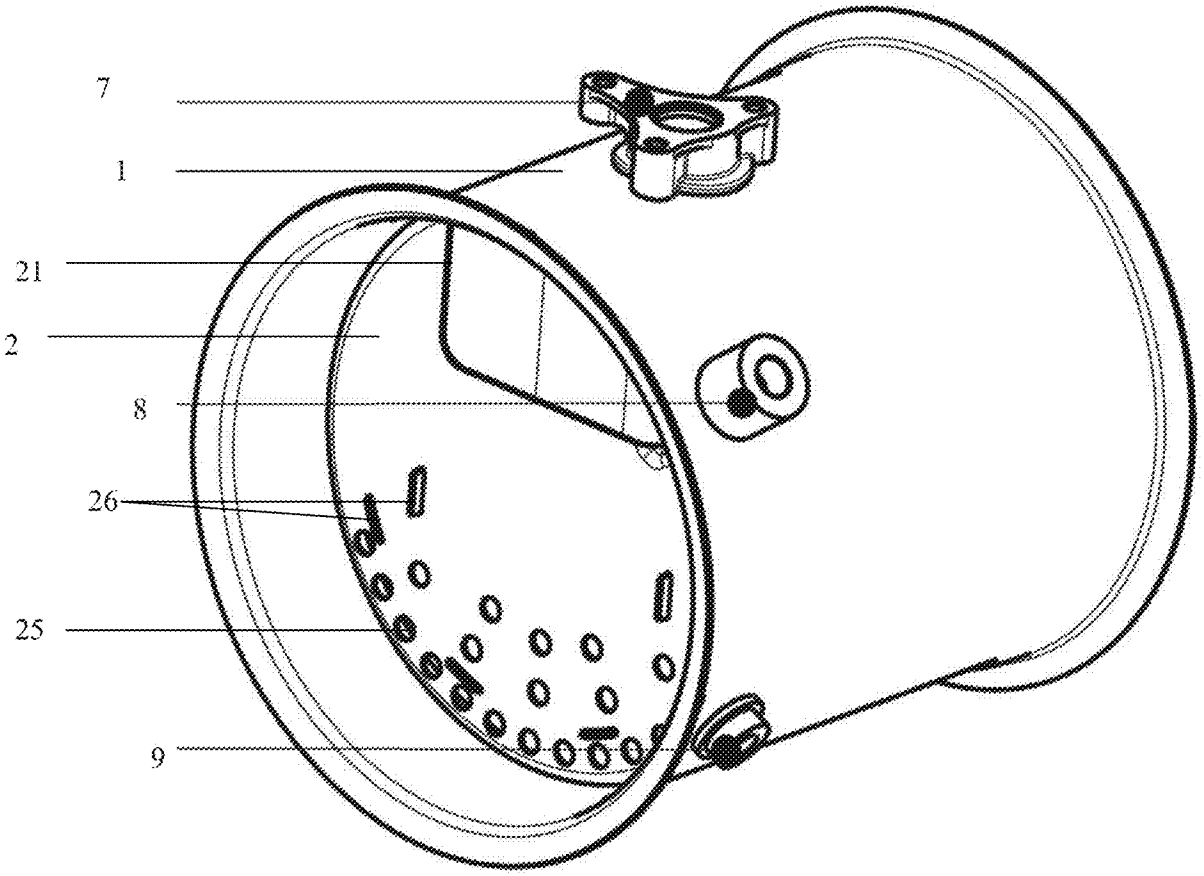
FIG. 1 is a perspective view of a mixer in accordance with an embodiment of the present disclosure from an angle.

Various implementations or embodiments carrying out the subject matter and technical solutions described are disclosed as follows. Specific instances of various elements and arrangements are described below for the purpose of simplifying the disclosure, and of course, these are merely examples and are not intended to limit the scope of the present disclosure. For example, a first feature recorded later in the specification being formed above or over a second feature can include an implementation of forming a direct contact of the first and second features, and can also include an implementation of forming an additional feature between the first feature and the second feature such that the first and second features may not be in direct contact. Additionally, reference numerals and/or letters may be repeated in different examples in these disclosures. This repetition is for the sake of brevity and clarity, and does not itself represent the relationship between the various implementations and/or structures to be discussed. Further, when a first element is described in connection with or in combination with a second element, the description includes an implementation in which the first and second elements are directly connected or combined to each other, and also includes the use of one or more other intervening elements such that the first and second elements are indirectly connected or combined to each other.

In addition, it should be understood that the orientation or positional relationship indicated by the orientation words such as "front, rear, up, down, left, right", "transverse, vertical, perpendicular, horizontal" and "top, bottom", etc. are usually based on orientation or positional relationship shown in the figures, and are merely for the convenience of the description of the present disclosure and simplifying the description, and unless stated to the contrary, the orientation words are not to indicate or imply that the device or element referred must have a specific orientation or be constructed and operated in a specific orientation, and thus are not to be explained as limiting the scope of the present disclosure; and the orientation words "inner, outer" refer to the inside and outside of the contour of each component, words "first", "second" and the like are used to limit the components and parts only for the purpose of facilitating the distinction between the corresponding components and parts, and unless otherwise stated, the above words have no special meaning and therefore cannot be interpreted as limiting the scope of protection of the present disclosure.

Also, the present application uses specific words to describe embodiments of the present application. The term "one embodiment", "an embodiment" and/or "some embodiments" or the like means certain feature, structure, or characteristic associated with at least one embodiment of the present application. Therefore, it should be emphasized and noted that "an embodiment" or "one embodiment" or "some embodiments" referred in two or more different positions in this specification does not necessarily refer to the same embodiment. Furthermore, some of the features, structures, or characteristics of one or more embodiments of the present application can be combined as appropriate.

As shown in FIGS. 1 to 5, in some embodiments, a mixer of an exhaust aftertreatment system comprises a shell 1, a first baffle 2, a second baffle 3, a deflector 5, and an impactor 6. The shell 1 is cylindrical as shown in FIGS. 1 to 5, but is not limited thereto. An outer wall of the shell 1 may be provided with an injection port 71 on which an injector seat 7 and an injector 10 are mounted, and the outer wall of the shell 1 may also be provided with sensors 8, 9 for monitoring parameters such as temperature, pressure and the like of an exhaust gas entering the mixer.

Figure 2:
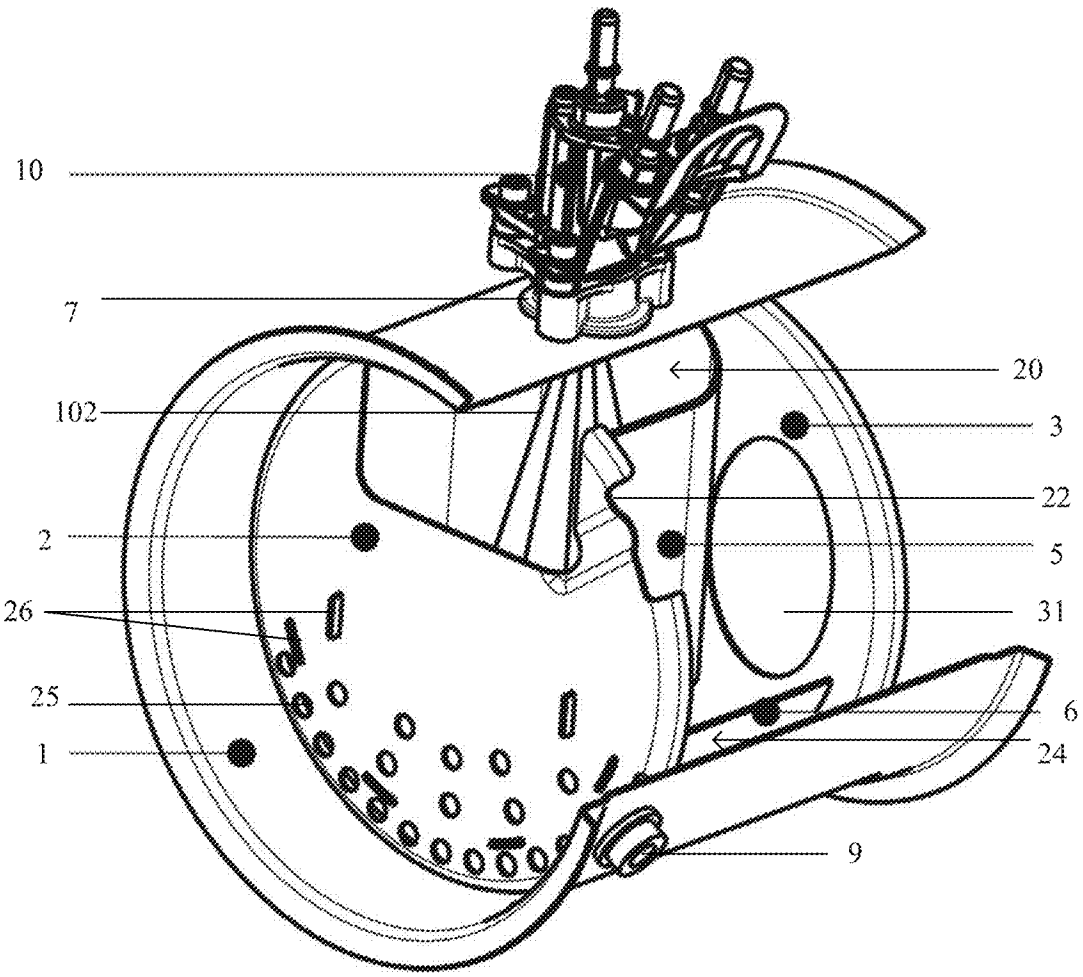
FIG. 2 is a view of a mixer, with a portion of a shell removed, in accordance with an embodiment of the present disclosure.
Figure 3:
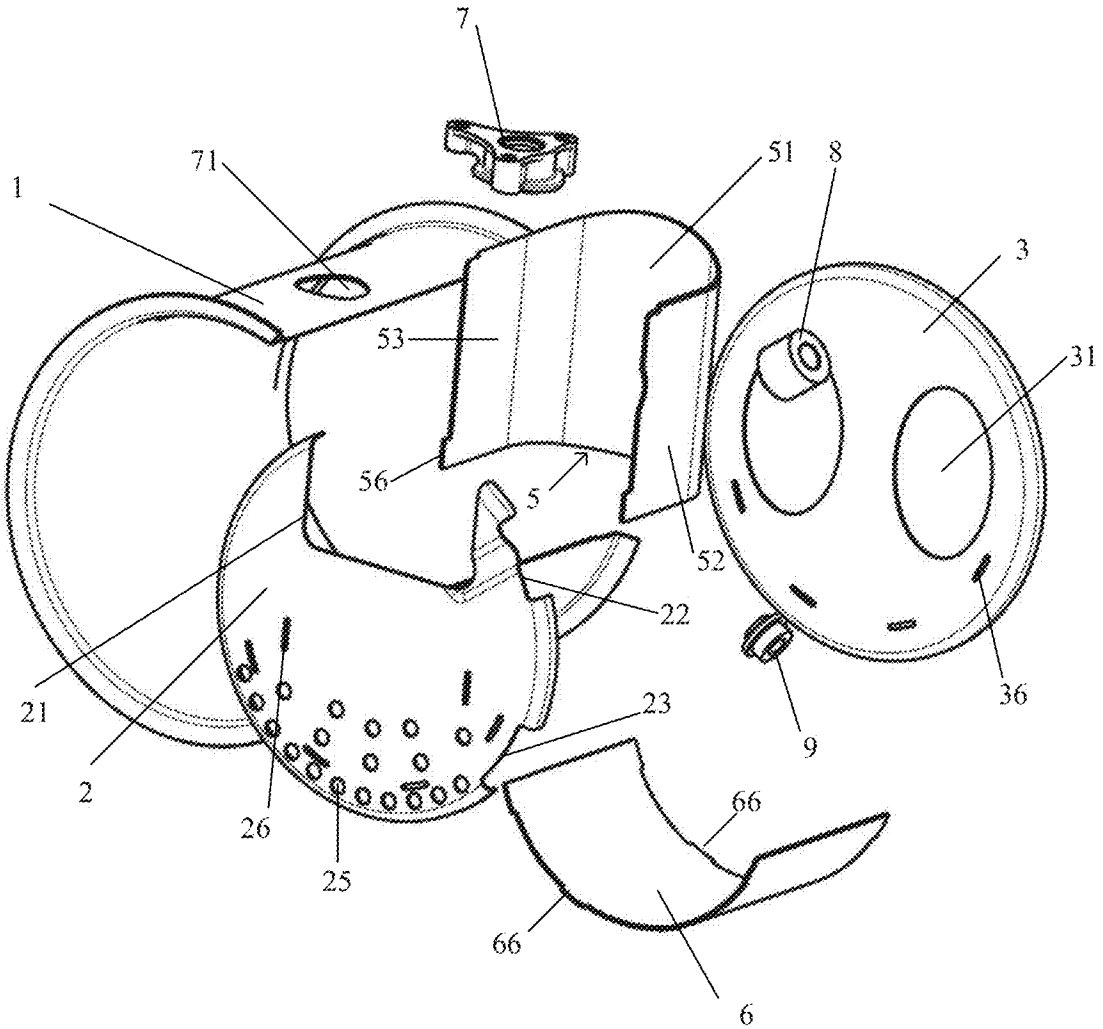
FIG. 3 is an exploded view of a mixer in accordance with an embodiment of the present disclosure.
Figure 4:
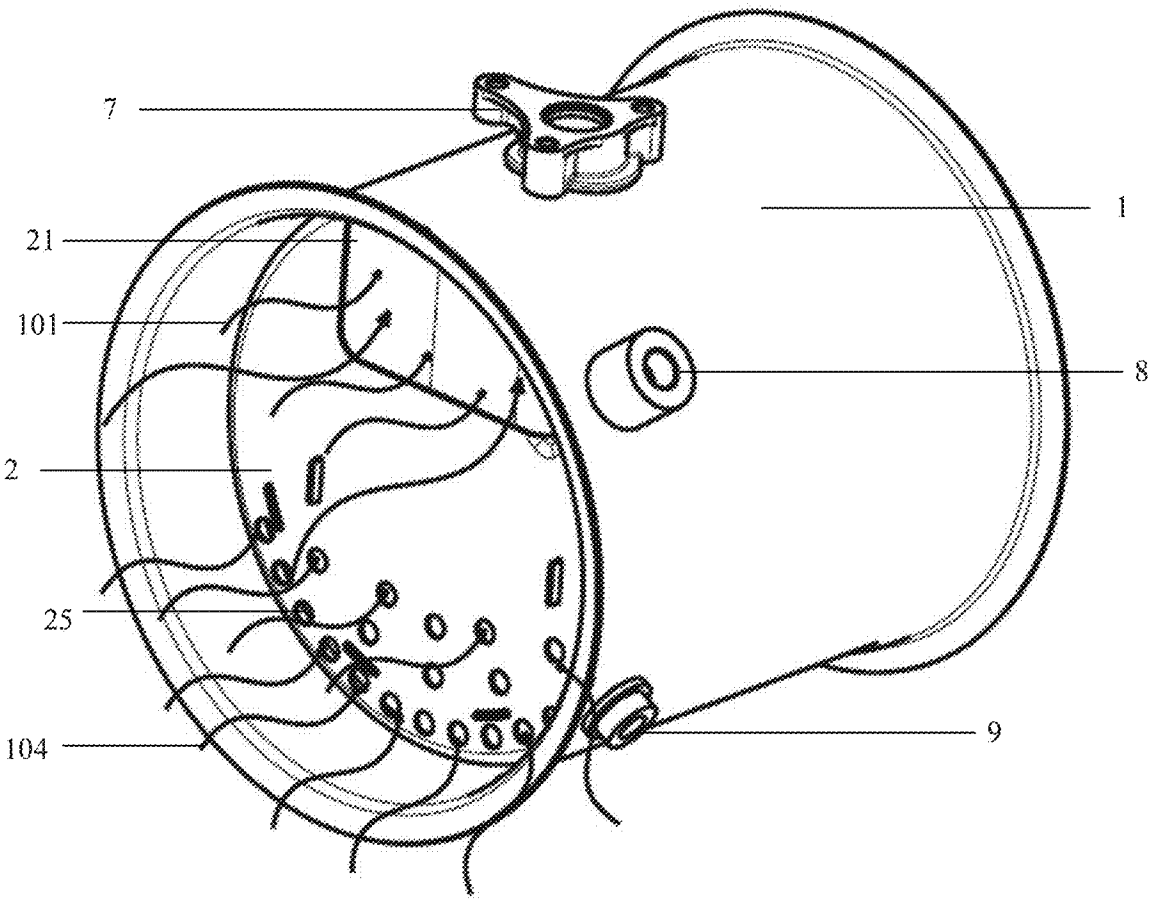
FIG. 4 is a schematic view of a mixer, into which an exhaust gas flows, of an embodiment of the present disclosure.
Figure 5:
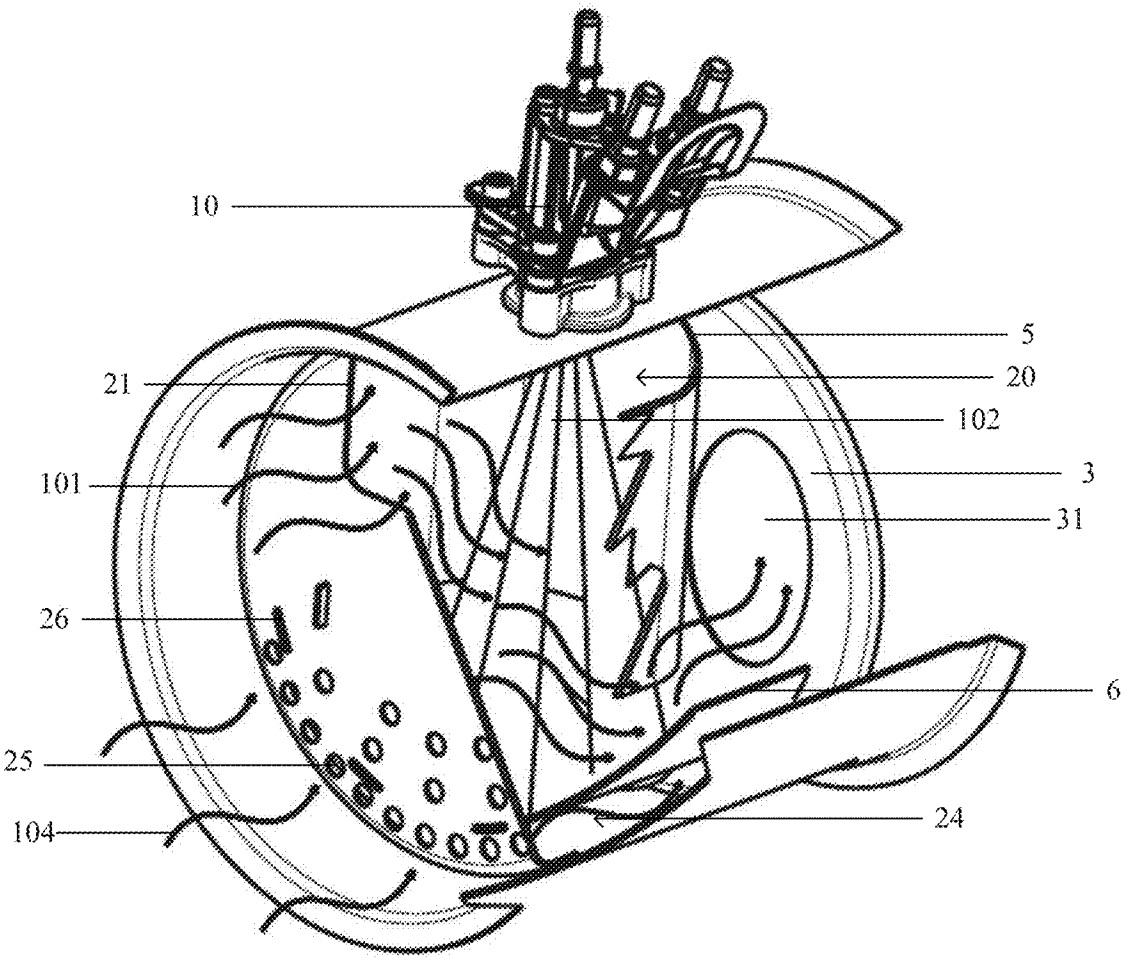
FIG. 5 is a schematic view of a mixer, inside which the exhaust gas flows, of an embodiment of the present disclosure.

The first baffle 2 is provided with a gas inlet 21 for the exhaust gas 101 to enter the mixer, and the first baffle 2 shown in FIGS. 2 and 3 also has notches 22, 23 to prevent sensor damage caused by positional interference with the sensors 8, 9. The second baffle 3 is provided with a gas outlet 31, that is, the exhaust gas 101 flows in a flow space provided by the first baffle 2, the second baffle 3 and the shell 1 which are disposed opposite each other. The first baffle 2 and the second baffle 3 may be substantially flat plates for convenient processing, the first baffle 2 and the second baffle 3 only require one punching apparatus, and they are first punched and then processed to form a gas inlet 21 and a gas outlet 31 and the like thereon.

In the flow space, the first baffle 2, the shell 1, the deflector 5, and the impactor 6 provide a mixing space 20 in which a liquid 102 is injected by the injector 10, and the liquid 102 is a liquid which includes a reducing agent component and can undergo a reduction reaction with nitrogen oxides contained in the exhaust gas 101, such as a commonly used urea solution, but not limited thereto. The deflector 5 comprises a first deflecting surface 51 opposite the first baffle 2, the deflector 5 is disposed adjacent to the impactor 6, and the impactor 6 is disposed opposite the injection port 71. That is, the impactor 6 is located in an injection path of the injector 10, and the liquid 102 injected from the injector 10 enters the mixing space, impacts with the impactor 6, and is atomized into small droplets.

The reason why the mixer structure thus designed can improve exhaust gas mixing uniformity, improve exhaust gas treatment efficiency, and reduce liquid solute (for example, urea) deposit is that, with reference to FIGS. 4 to 6B, after the exhaust gas 101 enters the mixer through the gas inlet 21, as the first deflecting surface 51 of the deflector 5 is opposite the first baffle 2 and adjacent to the impactor 6, most of the exhaust gas 101, after entering the flow space of the mixer, impacts with the injected liquid 102 and is driven by the liquid 102 to the impactor 6 disposed adjacent to the deflector 5, and the exhaust gas 101 not impacting with the liquid 102 or not driven by the liquid 102 flows to the first deflecting surface 51, and under the drive of the flow velocity of the nearby liquid 102 (according to Bernoulli's principle), is also deflected along the first deflecting surface 51 to the impactor 6 disposed adjacent to the deflector 5. Therefore, the exhaust gas 101, which is deflected by the liquid 102 and the first deflecting surface 51, gathers in the vicinity region of the impactor 6, and the heat of the exhaust gas 101 sufficiently heats the impactor 6, so that the injected liquid 102 is sufficiently heated and is sufficiently atomized after impacting with the impactor 6 to be decomposed into extremely fine droplets, thus increasing the specific surface area of the liquid and enabling same to be sufficiently mixed with the exhaust gas 101. At the same time, due to the drive of the liquid 102, the exhaust gas 101 is sufficiently mixed with urea droplets or ammonia decomposed by the urea droplets in the vicinity of the impactor 6, then quickly flows out of the mixing space 20 along the impactor 6 to the gas outlet 31 to be discharged from the mixer, and enters a selective catalytic reduction (SCR) catalyst downstream to undergo a redox reaction in which nitrogen oxide contaminants in the exhaust gas are reduced to pollution-free nitrogen and water. It can be understood that the deflector 5 does not only have the function of deflecting the exhaust gas 101, and a small amount of the liquid 102 injected by the injector 10 may also impact the deflector 5. Similarly, the impactor 6 does not only have the function of impacting the liquid 102, and may also serve to deflect a portion of the exhaust gas 101.

Preferably, the impactor 6 may be of a circular arc shape, but not limited herein, and the advantageous effect thereof is that the impactor 6 is easy to process, and can better gather the heat of the exhaust gas 101.

The exhaust gas 101 and the liquid 102 need not use the structurally complicated spiral deflector which is used in the prior art to improve the mixing effect of the two, or the technical solution of increasing the length of the mixer, which simplifies the structure of the deflector and reduces the processing cost of the mixer. At the same time, the length of the mixer is further shortened, so that it can be flexibly arranged in the entire exhaust aftertreatment system, and the valuable arrangement space inside the exhaust aftertreatment system is saved, which is advantageous for miniaturization of the exhaust aftertreatment system. In addition, the exhaust gas with a large amount of heat is collected at the impactor 6 by the method of impact and liquid injection, so that the temperature thereof can meet the requirement of urea decomposition, effectively reducing the deposit of a urea liquid, and ensuring that the mixer can operate stably and reliably for a long time.

With continued reference to FIGS. 2 and 3, in some embodiments, an example of a specific structure of the deflector 5 may be that the deflector 5 further comprises a second deflecting surface 52 and a third deflecting surface 53 which extend from two lateral ends of the first deflecting surface 51 toward the first baffle 2; and the deflector 5 designed in this way can cause multiple impacts between the exhaust gas 101 and the plurality of deflecting surfaces, and the exhaust gas is more deflected to the area near the impactor 6. Similarly, it is also possible to cause a plurality of impacts of more liquid 102 on the deflector 5 with the first deflecting surface 51, the second deflecting surface 52 and the third deflecting surface 53, so that the liquid 102 can be atomized and decomposed into finer droplets in the mixing space 20, so that the mixing effect of the exhaust gas 101 and the liquid 102 is better. Specifically, as shown in FIGS. 2 and 3, the specific structure of the deflector having three deflecting surfaces may be that the first deflecting surface 51 is a circular arc surface, and the second deflecting surface 52 and the third deflecting surface 53 are planes parallel to each other. Although there are other specific structures, for example, the first deflecting surface 51, the second deflecting surface 52 and the third deflecting surface 53 constitute a circular arc shape or other structure. The arrangement in which the first deflecting surface 51 is a circular arc surface and the second deflecting surface 52 and the third deflecting surface 53 are planes parallel to each other makes the deflector simple in structure and easy to process, and the exhaust gas 101 and the liquid 102 impact multiple times and the mixing effect is better.

With continued reference to FIGS. 2 and 3, in some embodiments, an example of a specific position of the gas inlet 21 may be that the gas inlet 21 and the injection port 71 are disposed on the same side with respect to an axis of the flow space, for example, as shown in FIGS. 2 and 3, the gas inlet 21 and the injection port 71 and the injector 10 mounted on same are both located on the upper side of the axis of the flow space, so that the advantageous effect is that the exhaust gas 101, after entering from the gas inlet 21, impacts and mixes with the urea liquid 102 injected from the injector 10, and the mixing uniformity of the exhaust gas 101 and the liquid 102 is improved.

Figure 6B:
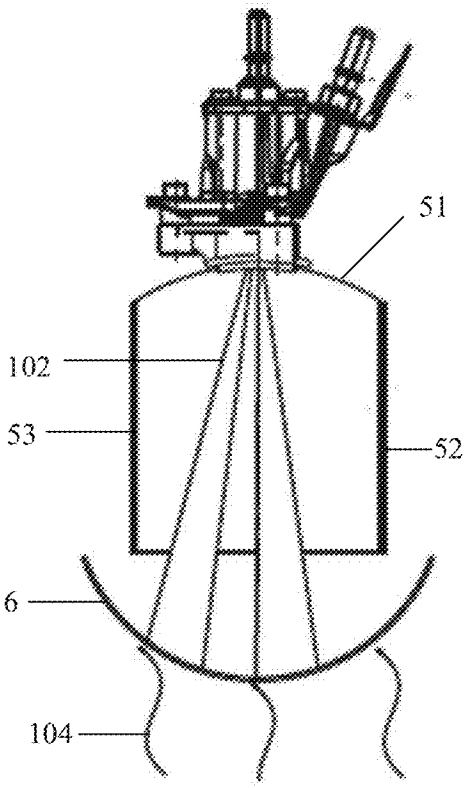
FIGS. 6A and 6B are schematic views of a mixer, inside which the exhaust gas and a liquid are mixed, of an embodiment of the present disclosure.
Figure 6A:
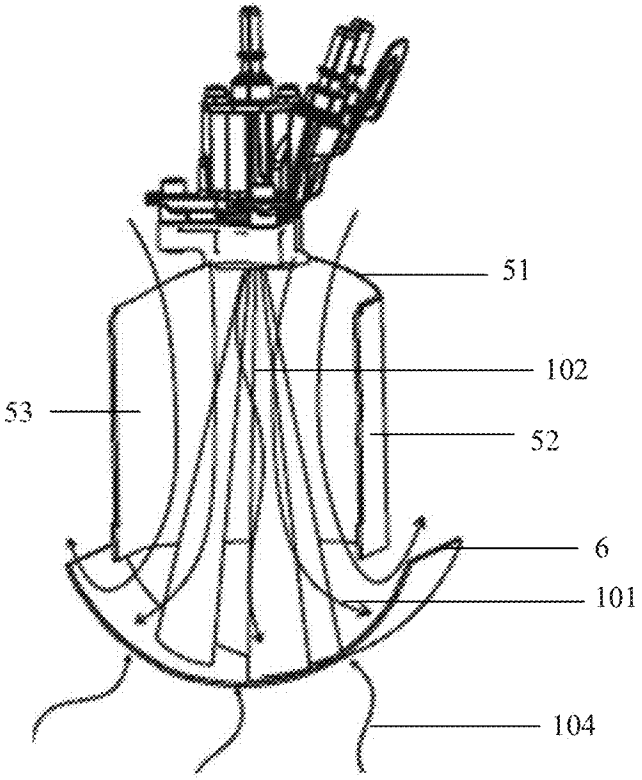

With reference to FIGS. 1 to 5, in some embodiments, a radial gap between the impactor 6 and an inner wall of the shell 1 and the first baffle 2 jointly provide a heating space 24, the first baffle 2 is provided with a gas inlet opening 25 for the exhaust gas 101 to flow into the heating space 24. It should be noted that in the embodiment in which the gas inlet opening 25 is provided, most of the exhaust gas 101 still flows from the gas inlet 21 into the mixer, and only a small portion of the exhaust gas 104 flows from the gas inlet opening 25, and the advantageous effect thereof is that, as shown in FIGS. 6A and 6B, the small portion of the exhaust gas 104 can further heat the impactor 6 by its own temperature, optimizing the impact effect of the liquid 102 on the impactor 6. Specific parameters such as the number of the gas inlet opening 25 and the size of the heating space 24 can be flexibly set according to actual requirements to fully utilize the positive effect of the heat of the exhaust gas 104 and also avoid excessive proportion of exhaust gas flowing into the heating space 24, which affects the mixing effect of the exhaust gas and the liquid.

With continued reference to FIGS. 1 to 5, in some embodiments, the first baffle 2 and/or the second baffle 3 have a plurality of plug welds 26, 36, and the impactor 6 and/or the deflector 5 are connected to the first baffle 2 and/or the second baffle 3 via the plug welds 26, 36, and as shown in FIGS. 1 to 5, the first baffle 2 and the second baffle 3 respectively have plug welds 26, 36, and the deflector 5 has a raised portion 56 that is engaged with the plug weld 26 such that the deflector 5 is connected to the first baffle 2. Likewise, the impactor 6 also has raised portions 66 that are engaged with the plug welds 26, 36, respectively, such that the impactor 6 can be connected to the first baffle 2 and the second baffle 3 respectively, but not limited thereto. Although there are other connection structures, the engagement of the raised portions and the plug welds has a simple structure and is easy to process and assemble.

In summary, the advantageous effects using the mixer and the exhaust aftertreatment system of the above embodiment include at least:

1. the first deflecting surface of the deflector is disposed opposite the first baffle and adjacent to the impactor, so that most of the exhaust gas enters from the gas inlet of the first baffle, impacts with the first deflecting surface, and under the combined action of the attractive force of the injected liquid and the resistance of the first deflecting surface, is forcibly deflected to the impactor disposed adjacent to the deflector, and the heat of the exhaust gas sufficiently heats the impactor, so that the injected liquid is fully atomized by the heat and impact with the impactor to be decomposed into extremely fine droplets, thus increasing the specific surface area of the liquid and enabling same to be sufficiently mixed with the exhaust gas;
2. the mixing of the exhaust gas and the liquid can be completed within a limited mixing distance, so that the mixer can further reduce the axial size and save on the valuable space arrangement inside the exhaust aftertreatment system;
3. the temperature of the impactor is high enough to effectively reduce the deposit of the solute such as the urea liquid injected into the liquid, ensuring stable and reliable operation of the mixer; and
4. the mixing efficiency of the exhaust gas and the liquid is high, which improves the treatment efficiency of the exhaust aftertreatment system, and at the same time, a power system can accordingly reduce the exhaust back pressure of the exhaust aftertreatment system and improve the fuel economy of the power system.

The present disclosure has been disclosed above as the above embodiments which, however, are not intended to limit the present disclosure, and any person skilled in the art could make possible changes and alterations without departing from the spirit and scope of the present disclosure. For example, other than the application to the vehicle, the exhaust aftertreatment system can be applied to diesel engines of conveyances such as ships, submarines, and the like, as well as exhaust aftertreatment of other power machines that need to reduce nitrogen oxide emissions; as a further example, the mixer can be applied to various application scenarios, for example, end-in and end-out, side-in and side-out, side-in and end-out, and end-in and side-out, and is also suitable for production in different sizes, such as 5-13 inches; and as a yet further example, the specific position of the injector 10, the number of impactors 6, etc. Hence, any alteration, equivalent change and modification which are made to the above-mentioned embodiments in accordance with the technical substance of the present disclosure and without departing from the contents of the technical solutions of the present disclosure would fall within the scope of protection defined by the claims of the present disclosure.

The invention claimed is:

1. A mixer for an exhaust aftertreatment system, comprising:

a shell, an injection port, a first baffle, a second baffle, a deflector, and an impactor, wherein the first baffle is provided with a gas inlet, the second baffle is provided with a gas outlet, the first baffle and the second baffle are disposed opposite each other, and the first baffle, the second baffle and the shell provide a flow space for an exhaust gas to flow in the mixer; and in the flow space, the first baffle, the shell, the deflector and the impactor provide a mixing space, the deflector comprises a first deflecting surface opposite the first baffle, the deflector is disposed adjacent to the impactor, and the impactor is disposed opposite the injection port for impacting a liquid injected from the injection port into the mixing space;

wherein the injection port, the first baffle, the deflector, and the impactor are arranged and shaped such that, during use and after the exhaust gas enters the flow space of the mixer through the gas inlet, most of the exhaust gas impacts with the liquid injected from the injection port and is driven by the liquid to the impactor, and the exhaust gas not impacting with and not being driven by the liquid flows to the deflector, under a drive of the flow velocity of the liquid nearby, is also deflected along the deflector to the impactor at which the exhaust gas divides into multiple flows.

2. The mixer of claim 1, wherein the impactor has a circular arc shape.

3. The mixer of claim 1, wherein the deflector further comprises a second deflecting surface and a third deflecting surface respectively extending from two lateral ends of the first deflecting surface toward the first baffle.

4. The mixer of claim 3, wherein the first deflecting surface is a circular arc surface, and the second deflecting surface and the third deflecting surface are planes parallel to each other.

5. The mixer of claim 1, wherein the gas inlet and the injection port are disposed on the same side with respect to an axis of the flow space.

6. The mixer of claim 1, wherein a radial gap is provided between the impactor and an inner wall of the shell, the radial gap and the first baffle jointly provide a heating space, and the first baffle is provided with a gas inlet opening for the exhaust gas to flow into the heating space.

7. The mixer of claim 1, wherein the first baffle and/or the second baffle have a plurality of plug welds, and the impactor and/or the deflector are connected to the first baffle and/or the second baffle via the plug welds.

8. The mixer of claim 1, wherein the liquid injected into the mixing space is a urea solution.

9. An exhaust aftertreatment system, comprising a mixer, wherein the mixer comprises:

a shell, an injection port, a first baffle, a second baffle, a deflector, and an impactor, wherein the first baffle is provided with a gas inlet, the second baffle is provided with a gas outlet, the first baffle and the second baffle are disposed opposite each other, and the first baffle, the second baffle and the shell provide a flow space for an exhaust gas to flow in the mixer; and in the flow space, the first baffle, the shell, the deflector and the impactor provide a mixing space, the deflector comprises a first deflecting surface opposite the first baffle, the deflector is disposed adjacent to the impactor, and the impactor is disposed opposite the injection port for impacting a liquid injected from the injection port into the mixing space;

wherein the injection port, the first baffle, the deflector, and the impactor are arranged and shaped such that, during use and after the exhaust gas enters the flow space of the mixer through the gas inlet, most of the exhaust gas impacts with the liquid injected from the injection port and is driven by the liquid to the impactor, and the exhaust gas not impacting with and not being driven by the liquid flows to the deflector, under a drive of the flow velocity of the liquid nearby, is also deflected along the deflector to the impactor at which the exhaust gas divides into multiple flows.

10. The exhaust aftertreatment system of claim 9, wherein the impactor has a circular arc shape.

11. The exhaust aftertreatment system of claim 9, wherein the deflector further comprises a second deflecting surface and a third deflecting surface respectively extending from two lateral ends of the first deflecting surface toward the first baffle.

12. The exhaust aftertreatment system of claim 11, wherein the first deflecting surface is a circular arc surface, and the second deflecting surface and the third deflecting surface are planes parallel to each other.

13. The exhaust aftertreatment system of claim 9, wherein the gas inlet and the injection port are disposed on the same side with respect to an axis of the flow space.

14. The exhaust aftertreatment system of claim 9, wherein a radial gap is provided between the impactor and an inner wall of the shell, the radial gap and the first baffle jointly provide a heating space, and the first baffle is provided with a gas inlet opening for the exhaust gas to flow into the heating space.

15. The exhaust aftertreatment system of claim 9, wherein the first baffle and/or the second baffle have a plurality of plug welds, and the impactor and/or the deflector are connected to the first baffle and/or the second baffle via the plug welds.

16. The exhaust aftertreatment system of claim 9, wherein the liquid injected into the mixing space is a urea solution.

* * * * *